US009809774B2

(12) United States Patent
Trass et al.

(10) Patent No.: US 9,809,774 B2
(45) Date of Patent: Nov. 7, 2017

(54) METHOD OF SEPARATING SOLIDS USING BIO-OILS

(71) Applicants: Olev Trass, Toronto (CA); Michael David McLaren, Guelph (CA)

(72) Inventors: Olev Trass, Toronto (CA); Michael David McLaren, Guelph (CA)

(73) Assignee: Converde Energy Inc., Cambridge, Ontario (CA)

( * ) Notice: Subject to any disclaimer, the term of this patent is extended or adjusted under 35 U.S.C. 154(b) by 0 days.

(21) Appl. No.: 14/894,363

(22) PCT Filed: Jun. 2, 2014

(86) PCT No.: PCT/CA2014/000469

§ 371 (c)(1),
(2) Date: Nov. 26, 2015

(87) PCT Pub. No.: WO2014/190420

PCT Pub. Date: Dec. 4, 2014

(65) Prior Publication Data

US 2016/0115411 A1 Apr. 28, 2016

Related U.S. Application Data

(60) Provisional application No. 61/829,460, filed on May 31, 2013.

(51) Int. Cl.
*C10L 9/02* (2006.01)
*B03D 1/006* (2006.01)
(Continued)

(52) U.S. Cl.
CPC ..... *C10L 9/02* (2013.01); *B03D 1/006* (2013.01); *B03D 1/008* (2013.01); *B03D 3/06* (2013.01);
(Continued)

(58) Field of Classification Search
USPC ..... 44/627
See application file for complete search history.

(56) References Cited

U.S. PATENT DOCUMENTS 4,406,664 A * 9/1983 Burgess ..... B03B 9/005 209/166
4,730,787 A * 3/1988 Trass ..... B03B 9/005 241/15

OTHER PUBLICATIONS

Song and Trass, Floc Flotation of Prince Coal with Simultaneous Grinding and Hydrophobic Flocculationin a Szego Mill. Fuel 76(9): 839-844, 1997.

* cited by examiner

*Primary Examiner* — Prem C Singh
*Assistant Examiner* — Chantel Graham
(74) *Attorney, Agent, or Firm* — Bereskin & Parr LLP/S.E.N.C.R.L., s.r.l.; Michael Fenwick

(57) ABSTRACT

A process for separating a solid having two or more components, at least one of which is lyophobic and at least one of which is lyophilic. The process comprises, in a single step, comminuting a mixture of the solid in a first liquid to which one of the components is lyophilic and to which the other component is lyophobic and in a second liquid which is immiscible with the first liquid and which will wet the lyophobic component to form agglomerates or floes of the lyophobic component and the second liquid in a mill having positive transport capability such that the mill causes the mixture to be transported therethrough. The second liquid comprises a bio-oil, bio-diesel or combination thereof. The agglomerates are then separated from the mixture. This process may be used for beneficiating a coal containing ash.

20 Claims, 2 Drawing Sheets

Figure 1:
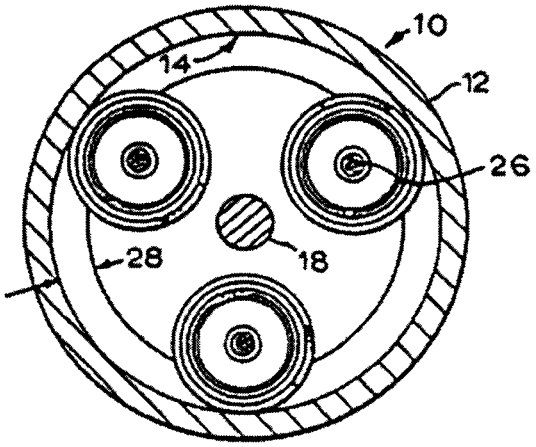

(51) Int. Cl.

| | |
|---|---|
| ***B03D 3/06*** | (2006.01) |
| ***B03D 1/008*** | (2006.01) |
| ***C11B 3/16*** | (2006.01) |
| *C10L 5/04* | (2006.01) |
| *B02C 17/16* | (2006.01) |

(52) U.S. Cl.

CPC ..... *C11B 3/16* (2013.01); *B02C 2017/165* (2013.01); *B03D 2203/08* (2013.01); *C10L 5/04* (2013.01); *C10L 2290/28* (2013.01); *C10L 2290/546* (2013.01)

METHOD OF SEPARATING SOLIDS USING BIO-OILS

This application is a national phase entry of PCT/CA2014/000469, filed Jun. 2, 2014, which claims priority from U.S. Provisional patent application Ser. No. 61/829,460 filed May 31, 2013, each of these applications being incorporated herein in their entirety by reference.

FIELD

The present disclosure relates to the separation of a solid by comminution and agglomeration or flocculation into its constituent lyophobic and lyophilic components.

INTRODUCTION

It is often desirable to separate a solid having lyophilic and lyophobic components into said components for cleaning or beneficiating purposes. One of the most frequent purposes for such a process is for beneficiating coal or coal-water slurries to reduce the ash content of same. Beneficiated coal slurries are used as combustion fuels and have the advantages of having increased heating value, lower sulphur content, reduced abrasion, and minimized ash handling and boiler derating.

SUMMARY

The present disclosure relates to a process for separating solids by simultaneous comminution, and agglomeration or flocculation using a bio-oil, bio-diesel, or combinations thereof. In particular, the disclosure relates to a process to separate a solid into its constituent lyophobic and lyophilic components, wherein the comminution and agglomeration or flocculation operations are performed in a mill having positive transport capability. The combining of these two operations reduces the energy and equipment needed for the separation process.

A mill that has a movable channel, so that it is capable of transporting cohesive mixtures, is said to have a transport capability. If the channels are arranged to transport the mixture through the mill in the direction of flow to assist gravity or whatever other agency feeds the mixture into and out of the mill, in the absence of a pressurized feed, the transport is termed positive.

The mill, in addition to having positive transport capability, will, in one embodiment, be a high speed, high shear mill, for example, a Szego mill.

In one embodiment of the disclosure, there is provided a process for separating a solid having two or more components, at least one of which is lyophobic and at least one of which is lyophilic. The process comprises, in a single step, comminuting a mixture of the solid in a first liquid to which one of the components is lyophilic and to which the other component is lyophobic and in a second liquid which is immiscible with the first liquid and which will wet the lyophobic component to form agglomerates or flocs of the lyophobic component and the second liquid in a mill having positive transport capability; and thereafter, the further step of separating the agglomerates or flocs from the mixture, wherein the second liquid comprises a bio-oil, a bio-diesel, or combinations thereof. Typically, the components of the solid to be separated will be hydrophobic and hydrophilic, and thus the liquids used will be an aqueous solvent, such as water, and a liquid immiscible with an aqueous solvent, for example a bio-oil, bio-diesel or combinations thereof, which wets and agglomerates or flocculates the hydrophobic component.

In accordance with another aspect of the disclosure there is provided a process for beneficiating coal containing ash. The process comprises, in a single step, comminuting a mixture of coal, aqueous solvent, such as water, and bio-oil, bio-diesel or combinations thereof, to liberate at least a portion of the ash and coal in particulate form, and to form agglomerates or flocs of the coal particles and the bio-oil and/or bio-diesel in a mill having positive transport capability; and thereafter, the further step of separating the agglomerates or flocs from the mixture.

DRAWINGS

Figure 2:
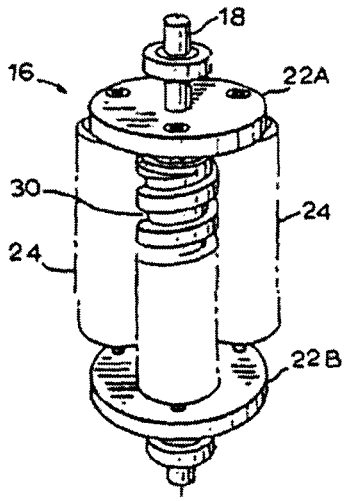

The disclosure will now be further described, with reference to exemplary embodiments, as illustrated in the accompanying drawings in which FIG. 1 is a plan view in section of a mill having positive transport capability; and FIG. 2 is a perspective view of part of the mill of FIG. 1.

DESCRIPTION OF VARIOUS EMBODIMENTS

It will be understood that the process of the present disclosure has application whenever it is desired to separate a solid such as a mineral or a metal having at least one lyophobic and at least one lyophilic component. The liquids used for the separation, together with the operating parameters of the process, will vary according to the properties of the particular solid being separated. However, the process will involve comminuting the solid in a first liquid to which one of the components is lyophilic and to which the other component is lyophobic and in a second liquid which is immiscible with the first liquid and which will wet the lyophobic component. If the components are hydrophilic and hydrophobic, as will usually be the case, the first liquid will be an aqueous solvent such as water, and the second liquid will comprise a bio-oil, bio-diesel or combination thereof, which is immiscible with water.

The general process of the disclosure proceeds as follows, where in one embodiment, the solid is coal containing ash. A coal containing ash, in a particulate form, together with an aqueous solvent, such as water, and bio-oil, bio-diesel or combination thereof, is fed into a mill having positive transport capability. In the mill this mixture is comminuted to liberate the ash component, in particulate form, into the aqueous phase and to form agglomerates or flocs of the coal particles with oil. The mixture containing the agglomerates or flocs is then removed from the mill and in one embodiment, the agglomerates are separated on an appropriate mesh screen to produce an ash-aqueous stream and a coal-bio-oil or bio-diesel agglomerate product. In another embodiment, when the process generates flocs of bio-oil or bio-diesel and coal particles, the flocs are recovered by flotation (see for example, Song and Trass, Floc flotation of Prince Coal with Simultaneous Grinding and Hydrophobic Flocculationin a Szego Mill, Fuel, Vol. 76, No. 9, pp. 839-844, 1997).

An exemplary mill having positive transport capability is shown in FIGS. 1 and 2. The mill is known in the art as the Szego mill and will be only briefly described herein.

The mill 10 comprises a housing 12 forming an inner stationary, cylindrical grinding surface 14. A rotary assembly 16 is located within the housing 12 and includes a central shaft 18 rotatably driven by a motor (not shown). Keyed to the shaft 18 are upper and lower drive plates 22A and 22B respectively. Mounted vertically between the drive plates 22A, 22B are three helically grooved rollers 24. The rollers 24 rotate freely with respect to the plates 22A, 22B about axes parallel to the shaft 18. To that end, the rollers 24 are suspended on vertical shafts 26 rotatably connected to the plates 22A, 22B, such that they are flexibly movable with respect to the grinding surface for radial mobility.

When the shaft 18 and plates 22A, 22B are rotated, the rollers 24 roll around the grinding surface 14. The flexible connection allows the rollers 24 to press against the surface 14 as a result of the centrifugal force of rotation.

In operation, the solids and liquids, here coal, bio-oil, biodiesel, or combinations thereof, and an aqueous solvent, to be comminuted and agglomerated are fed by gravity into the top of the mill 10 through the drive plate 22A from a feed cylinder (not shown). The mixture falls down into the annular gap 28 between the plate 22A and the surface 14; is comminuted by the rollers 24 against the surface 14 as it passes through the mill; forms agglomerates as the solid is comminuted and transported downwardly through the mill; and is discharged from the mill through the gap (not shown) between the bottom plate 22B and the surface 14.

The mill 10 has positive transport capability as called for in the disclosure, in that the rollers 24 are each formed with a helical groove 30. The action of the groove causes comminuted particles to move downwardly in the mill and thus moves the mixture through the mill.

This positive transport capability thus provides a means for controlling the residence time and thus the degree of comminution and agglomeration achieved within the mill. Most importantly, the positive transport capability allows one to form agglomerates within the mill without the mill becoming plugged, something which readily happens if the same operation is attempted in an agitated media mill.

The mill 10 has been found to have the further benefit of improved ash liberation. The rolling action of the mill generally results in the formation of flaky rather than spherical particles. Spherical particles typically result when grinding in a ball mill and/or a stirred media mill. Ash liberation depends on the exposed surface area of the comminuted particle. Thus, with flaky particles, improved ash liberation results, since the flake thickness is more important than the flake diameter, the commonly measured parameter. Stated in another way, for good ash liberation and removal, it is not necessary to grind as fine in the positive transport mill as in a ball mill.

The first liquid as defined herein is an aqueous solvent which is immiscible with the second liquid, and refers to any solvent in which water comprises the majority of the solvent (typically at least: 80%, 85%, 90%, 95%, 98%, 99 or 99.9% water by weight), or pure water. The pure water is optionally a solvent consisting of pure water, such as deionized or distilled water. Examples of aqueous solvents include water (for example, tap water, distilled water, or reverse osmosis water), acidic water, alkaline water, saline solutions (such as sea water, including sodium chloride, potassium chloride, calcium chloride etc.). It would be understood by a person skilled in the art that tap water, for example, would contain natural minerals, salts and/or other solutes, which would not affect the process of the disclosure. The term aqueous solvent also includes substantially pure forms of water, such as distilled water, well water, spring water, tap water and the like, and impure water, including, but not limited to sea water, lake water, waste water, water from tailings ponds etc.

The bio-oil used in the process refers to any food-grade or non-food grade oils that are derived from plants and/or animals (e.g., vegetable oils). Examples of bio-oils derived from plants include, but are not limited to, camolina oil, sunflour oil, mustard seed oil, soya oil, corn oil, flaxseed oil, rapeseed (canola) oil, and the like.

The bio-diesel used in the process refers to any mono alkyl esters of long chain fatty acids produced from biological feedstocks such as vegetable oils or animal fats, or other feedstocks. Representative fatty acid mono alkyl esters include, but are not limited to fatty acid methyl esters, fatty acid ethyl esters and iso-propyl esters. The properties of the bio-oils and bio-diesels, such as for example the density and viscosity properties, help with the agglomeration and/or floc formation of the solid particles (coal particles), compared to petroleum oils. In one embodiment, bio-oils and bio-diesels are emulsified more easily with aqueous solvents and result in more stable emulsions which results in a higher capture of the solid such as coal. The use of bio-oils, bio-diesels or combinations thereof results in enhanced solid recovery compared with petroleum or fuel oils. In one embodiment, the bio-oils and bio-diesels form stable emulsions at low concentrations when used in the process of the present application.

In one embodiment, the second liquid is a bio-oil. In another embodiment, the second liquid is a bio-diesel, for example the iso-propyl ester of long chain fatty acids.

The choice of bio-oil or bio-diesel will depend on the type of solid used, and in particular, the type of coal used, the availability of suitable liquids, and of course the desired efficiency and economics of the process.

The bio-oil and bio-diesel may be used alone or in combination as mixture in the process of the present disclosure. In addition, the bio-oil and bio-diesel, alone or in combination, may also be further combined with other hydrocarbons or oils such as light oils, for example, No. 2 fuel oil, diesel oil, light petroleum fractions, kerosene, coke oven light oil, light crude, and residual and waste oils.

The amounts of bio-oil and/or bio-diesel and aqueous solvent included in the process will vary with the type of feedstock, the type of coal, the purpose of the process, and the desired economics and efficiency of the process. In both cases, however, there should be included sufficient oil and aqueous solvent to cause agglomerates or flocs to form.

For the purpose of this specification, the values given for aqueous solvent, bio-oil and/or bio-diesel and solid (such as coal) content are, unless otherwise specified, by weight based on the total mixture.

When the process is used to beneficiate an ash-containing coal, the process parameters will vary with the purpose of the process. For instance, if the purpose is to produce a relatively dry agglomerate it is preferable to use a high percentage of bio-oil and/or bio-diesel, typically in the range of about 5 to 10%. A lesser amount of bio-oil and/or bio-diesel is used, for example about 3 to 5%, if it is desired to minimize costs. If it is desirous to minimize the amount of pyrites in the coal, an even lesser amount of bio-oil and/or bio-diesel is used, for example about 3% or less, optionally less than about 2% or less than about 1%. The amount of aqueous solvent used is preferably at least about 40% and more preferably about 45 to 55%. Depending on the coal type and the fineness of comminution at less than about 35 to 40% aqueous solvent, a thick pasty mixture may form in the mill. In such a mixture agglomeration in a continuous aqueous phase is not readily discernable. One should, therefore, preferably conduct the process at an aqueous solvent content above this level. If the coal is very finely comminuted more aqueous solvent is needed.

The feedstock to be separated may alternatively be a stream recovered from a coal tailings pond. When coal has been sitting in a pond for a number of years, the coal surface becomes oxidized and is more hydrophilic than a fresh coal surface. The comminution step of this process exposes fresh coal surfaces which then respond to agglomeration in the mills with the same amounts of bio-oil and/or bio-diesel and aqueous solvent as stated above.

The feedstock to be separated may be a very dilute coal-aqueous slurry, for instance a coal tailings stream which is normally pumped from a coal preparation plant to a tailings pond. Such a tailings stream typically comprises about 90% water and 10% coal. When this dilute feedstock is treated in accordance with this process, the addition of about 1 to 2% by weight oil, or not less than that needed to give a coal-to-oil ratio of 0.05, is sufficient to form agglomerates.

In one embodiment, the mixture discharged from the mill is separated on a screen having a mesh size to retain most of the agglomerates. Once the free water and ash are removed, it is preferable to stir the agglomerates in another vessel with fresh aqueous solvent to allow further ash liberation. This final mixture is then passed through another screen to produce agglomerates significantly reduced in ash.

In another embodiment, when it is desirous to remove pyrites from the coal and a lesser amount of bio-oil and/or bio-diesel is used, the aggolomerates are in the form of flocs and are therefore recovered by flotation. In one embodiment, the mixture discharged from the mill is separated using flotation, as described in Song and Trass, Floc flotation of Prince Coal with Simultaneous Grinding and Hydrophobic Flocculationin a Szego Mill, Fuel, Vol. 76, No. 9, pp. 839-844, 1997.

To produce a combustible fuel, the separated agglomerates or flocs may be treated with a detergent or surface active agent to produce a homogeneous coal-oil-aqueous solvent slurry, as is well known in the art. To reduce the sulphur dioxide emission following the combustion of this slurry fuel product, limestone, in particulate form, may be added during the preparation of the fuel. To that end, a final fuel preparation step may be carried out in a second Szego mill wherein the agglomerates or flocs, the detergent additive and the particulate limestone are passed through the mill.

The following examples are included to demonstrate the operability, efficiency and preferred operating parameters of the process.

EXAMPLES

Example 1—Agglomeration of Coal with Bio-Oils

This example investigated bio-oils for their ability to agglomerate combustible matter in coal.

Tennessee bituminous coal was used, which has a relatively low ash level. The measured value of samples used was 12%. The oils used were regular diesel oil for comparison, bio-diesel oil, canola oil and restaurant waste oil.

A food blender was used to stir 100 g of ground coal (<147 um) and 15 g of the selected oil in one liter of water for 3 minutes to allow agglomeration to take place. Growth of the agglomerates was then effected by manual stirring of the mix for another 3-5 minutes. Thereafter, the mixture was poured onto a 100 mesh (147 um) screen. The ash-laden water was filtered, and the streams dried and weighed for initial agglomeration results. Ash analysis of the same samples allows calculation of both combustibles recovery and ash reduction.

The results obtained as described below indicate rapid agglomeration with all three bio-oils tested. Even at the high-speed mixing stage it was possible to observe black agglomerates in grey water, and more visibly so during the manual stirring stage. Indeed, all bio-oils caused faster agglomeration than did the diesel fuel which required a longer period of manual stirring to distinctively show agglomeration.

Even without analysis, it was obvious that combustibles recovery with all bio-oils was essentially complete, at 100%. There was virtually no black, carbonaceous material on the filter. With diesel, recovery was in the 99+% range, with less than half a gram of carbon on the filter.

Ash levels in the agglomerates and the corresponding ash reduction ratios were:

(I) Canola oil—5.3% ash, a reduction of 2.3 times from feed coal ash;

(II) Waste oil—6.2% ash, a reduction of 2.0 times from feed coal ash;

(III) Biodiesel—5.6% ash, a reduction of 2.2 times from feed coal ash;

(IV) Diesel oil—5.3% ash, a reduction of 2.3 times from feed coal ash.

As the coal was relatively finely ground, water retention in the samples was in the 40-50% range, with only gravity separation through the screen. As a result, some of the ash dispersed in water was actually retained on the dried samples. Therefore, one sample, the waste oil agglomerates, was re-washed with one liter of additional water for a 100 g sample, and analyzed again. The additional ash reduction amounted to about one percent, from 6.2 to 5.3% retained ash. That was also repeated with regular diesel oil and the ash level decreased from 5.3 to 4.8%.

Example 2—Agglomeration of Coal with Restaurant Waste Oil and Diesel Oil

In order to explore the level where reduced use of oil begins to lead to loss of combustibles, waste vegetable oil and diesel oil were used at progressively lower oil levels. Experiments were carried out at 9% and 6% of the amount of coal used, with the following results.

(I) 9% Waste oil—6.1% ash retained, with combustibles loss of 0.9%.

(II) 9% Diesel oil—3.8% ash retained, with combustibles loss of 3.9%.

(III) 6% Waste oil—5.7% ash retained, with combustibles loss of 4.7%.

(IV) 6% Diesel oil—4.2% ash retained, Combustibles loss 8.3%.

Bio-oils agglomerate Tennessee coal (and likely other bituminous and sub-bituminous coals) better than diesel oil. The latter leads consistently to higher combustible material losses (i.e. that the agglomerates are weaker for separation by screening). This also means that coal particles which are composed of both combustible matter and ash-forming minerals report more readily with the agglomerated coal when bio-oils are used, shown by the consistently higher levels of ash retained in the agglomerated material.

Prophetic Example 3—Comminuting Coal with Rapeseed Oil

To demonstrate the grinding (comminuting) efficiency of the process and the effect of solids content on the process, a number of coal samples are passed through a positive transport mill in a two-phase, coal-water slurry and in a threephase, coal-oil-water slurry. The procedure will be as follows:

A Szego mill of 22 cm diameter size, equipped with three, 30 cm long, fine-grooved rollers, is used. It is operated at a constant rotational speed of 800 rpm. The feed coal is initially crushed to a size of about 4 mm. The bio-oil used is rapeseed oil. Five kilograms of coal are fed into the mill at a feed rate of 270 kg/hr on a dry basis. The oil-to-coal ratio and water-to-coal ratios are varied between 0.05 and 0.15 and between 0.8 and 2.0, respectively.

The products discharged from the mill are collected, weighed and analyzed. A sieve analysis is used for the particle size range of 63 μm and greater. The sample products are washed with varsol and then with detergent and water. A Malvern particle size analyzer is used for smaller particles.

Prophetic Example 4—Comminuting Coal with Bio-Diesel (Rapeseed Oil Methyl Ester)

The process of prophetic Example #3 is repeated using a methyl ester bio-diesel prepared from rapeseed oil.

Prophetic Example 5—Comminuting Coal with Low Rapeseed Oil Concentration

To demonstrate the simultaneous grinding and flocculation of coal using low oil concentrations. A number of coal sample are passed through the Szego Mill described above along with some water and rapeseed oil emulsified in water The oil-to-coal and water-to-coal ratios are varied between ½ to 3%, 0.005 to 0.03 and between 1.0 and 2.0.

The products discharged from the mill are fed into a flotation cell along with a small amount of frother, e.g. 60 g per tonne of coal. Air is bubbled in from the bottom of the cell, the coal-oil flocs adhere to the air bubbles, are floated to the top of the cell and are withdrawn there. The ash-pyrites-laden water are withdrawn at the bottom of the cell.

The particle sizes of both streams are measured and the ash level in the floated coal will also be determined. Coal recovery, percent ash removal and percent pyrites removal will be calculated from the measured results.

Prophetic Example 6—Comminuting Coal with Low Rapeseed Bio-Diesel Concentration

The process of prophetic Example #5 is repeated using a methyl ester bio-diesel prepared from rapeseed oil.

The invention claimed is:

1. A process for separating a solid having two or more components, at least one of which is lyophobic and at least one of which is lyophilic, comprising:

In a single step comminuting a mixture of the solid in a first liquid to which one of the components is lyophilic and to which the other component is lyophobic and in a second liquid which is immiscible with the first liquid and which will wet the lyophobic component to form agglomerates or flocs of the lyophobic component and the second liquid, in a mill having positive transport capability such that the mill causes the mixture to be transported therethrough, wherein the second liquid comprises a bio-oil, bio-diesel or combination thereof; and thereafter, the further step of separating the agglomerates from the mixture, wherein the bio-oil, bio-diesel or combination thereof, is present in an amount of at least about 1% (w/w) based on the weight of the total mixture.

2. The process according to claim 1, wherein the solid is a coal containing coal and ash components.

3. The process as set out in claim 1, wherein the mill includes a stationary grinding surface and at least one roller adapted to rotate against the grinding surface, the roller having at least one helical groove such that rotation of the roller against the grinding surface creates at least one moveable channel in which to positively transport the mixture through the mill.

4. The process as set out in claim 1, wherein the bio-oil is camelina oil, sunflower oil, mustard seed oil, soya oil, corn oil, flaxseed oil, rapeseed (canola) oil, or mixtures thereof, and the bio-diesel is an alkyl ester of long chain fatty acids.

5. The process as set out in claim 4 wherein the comminution and agglomeration or flocculation is carried out in a Szego mill.

6. A process for separating a solid having two or more components, at least one of which is hydrophobic and at least one of which is hydrophilic, comprising:

in a single step comminuting a mixture of the solid in an aqueous solvent and liquid which is immiscible with the aqueous solvent and which will wet the hydrophobic component to form agglomerates or flocs of the hydrophobic component and the immiscible liquid, in a mill having positive transport capability, such that the mill causes the mixture to be transported therethrough, wherein the immiscible liquid comprises a bio-oil, bio-diesel or combination thereof;

and thereafter, the further step of separating the agglomerates from the mixture, wherein the bio-oil, bio-diesel or combination thereof, is present in an amount of at least about 1% (w/w) based on the weight of the total mixture.

7. The process as set forth in claim 1 wherein the comminution and agglomeration or flocculation is carried out in a high speed, high shear mill.

8. The process as set forth in claim 6, wherein the mill includes a stationary grinding surface and at least one roller adapted to rotate against the grinding surface, the roller having at least one helical groove, such that rotation of the roller against the grinding surface creates at least one moveable channel in which to positively transport the mixture through the mill.

9. The process as set forth in claim 8, wherein the solid is a coal containing coal and ash components.

10. The process as set forth in claim 9, wherein the aqueous solvent is included in an amount sufficient to cause agglomeration or flocculation.

11. The process as set forth in claim 6, wherein the bio-oil is camelina oil, sunflour oil, mustard seed oil, soya oil, corn oil, flaxseed oil, rapeseed (canola) oil, or mixtures thereof, and the bio-diesel is an alkyl ester of long chain fatty acids and the bio-oil or bio-diesel is included in an amount sufficient to cause agglomeration or flocculation.

12. The process as set forth in 6 wherein the bio-oil, bio-diesel or combination thereof is included in an amount not greater than about 10% of the total mixture.

13. The process as set forth in claim 1, wherein the immiscible liquid further comprises a hydrocarbon such as a petroleum or fuel oil.

14. The process as set forth in claim 13, wherein the comminution and agglomeration is carried out in a Szego mill.

15. A process for beneficiating a coal containing ash, comprising:

in a single step, comminuting a mixture of coal, aqueous solvent and bio-oil, bio-diesel or combinations thereof, to liberate at least a portion of the ash and coal in particulate form, and to form agglomerates or flocs of the coal particles and the bio-oil or bio-diesel in a mill having positive transport capability, such that the mill causes the mixture to be transported therethrough;

and thereafter, the further step of separating the agglomerates or flocs from the mixture, wherein the bio-oil, bio-diesel or combination thereof, is present in an amount of at least about 1% (w/w) based on the weight of the total mixture.

16. The process as set forth in claim 15, wherein the aqueous solvent is included in an amount of at least about 40% by weight of the total mixture, and the bio-oil and/or bio-diesel is included in an amount of at least about 3% by weight of the total mixture.

17. The process as set forth in claim 15, wherein the comminution and agglomeration is carried out in a high speed, high shear mill.

18. The process as set forth in claim 15, wherein the mill includes a stationary grinding surface and at least one roller adapted to rotate against the grinding surface, the roller having at least one helical groove, such that rotation of the roller against the grinding surface creates at least one moveable channel in which to positively transport the mixture through the mill.

19. The process as set forth in claim 15 wherein the comminution and agglomeration is carried out in a Szego mill.

20. The process according to claim 1, wherein the bio-oil and/or bio-diesel further comprises other hydrocarbons or oils such as light oils, for example, No. 2 fuel oil, diesel oil, light petroleum fractions, kerosene, coke oven light oil, light crude, and residual and waste oils.

* * * * *